US005145078A

United States Patent [19]

Hannon et al.

[11] Patent Number: 5,145,078

[45] Date of Patent: Sep. 8, 1992

[54] PILFER-PROOF BOTTLE CAP

[76] Inventors: Charles Hannon, 27 Sargent Rd., Scarsdale, N.Y. 10583; Leonard J. Vallender, 11 Clover Rd., Valhalla, N.Y. 10595

[21] Appl. No.: 750,446

[22] Filed: Aug. 20, 1991

Related U.S. Application Data

[63] Continuation of Ser. No. 538,383.

[51] Int. Cl.[5] ..... B65D 41/34

[52] U.S. Cl. ..... 215/252; 215/258

[58] Field of Search ..... 215/252, 258

[56] References Cited

U.S. PATENT DOCUMENTS

| | | | |
|---|---|---|---|
| 4,394,918 | 7/1983 | Grussen | 215/243 |
| 4,470,513 | 9/1984 | Ostrowsky | 215/252 |
| 4,478,343 | 10/1984 | Ostrowsky | 215/252 |
| 4,550,844 | 11/1985 | Lininger | 215/252 |
| 4,592,475 | 6/1986 | Hannon et al. | 215/252 |
| 4,595,110 | 6/1986 | Herr | 215/252 |
| 4,653,657 | 3/1987 | Papavasilopoulos | 215/252 |
| 4,694,969 | 9/1987 | Granat | 215/252 |
| 4,694,970 | 9/1987 | Hayes | 215/276 X |
| 4,801,030 | 1/1989 | Barriac | 215/252 |
| 4,801,031 | 1/1989 | Barriac | 215/252 |
| 4,807,771 | 2/1989 | Roy et al. | 215/252 |
| 4,848,614 | 7/1989 | Csaszar | 215/252 |
| 4,978,016 | 12/1990 | Hayes | 215/252 |

*Primary Examiner*—Stephen Marcus
*Assistant Examiner*—Vanessa Caretto
*Attorney, Agent, or Firm*—Israel Nissenbaum

[57] ABSTRACT

An improved pilfer-proof screw-on bottle cap having a ring section attached thereto with frangible bridges, wherein the ring section has at least four inwardly extending molded-in-place hooks. The hooks are circumferentially positioned at the edge of the ring section distal to the cap and engage a radially extending bead on the bottle, thereby preventing upward movement of the ring section together with removal of the bottle cap. The frangible bridges break under continued removal forces, thereby causing the ring section to become detached as an indication of tampering. The frangible bridges are located relative to the radially extending bead of the bottle at a position proximate to and no higher than the lower edge of the bead. Tampering removal of the cap and ring section, as a unit, by deliberate disengagement between the hooks and the bead, caused by squeezing of the ring to swivel the hooks away from the bead, causes the frangible bridges to move to breakage, as a lever against the lower edge of the bead as a fulcrum.

7 Claims, 2 Drawing Sheets

PILFER-PROOF BOTTLE CAP

This is a continuation of copending application Ser. No. 07/538,383 filed on Jun. 14, 1990, now abandoned.

This invention relates to plastic "pilfer-proof" screw-on bottle caps and in particular plastic bottle caps which have a ring separable from the cap as an indication of tampering.

Plastic bottle tops, while considerably more economical to manufacture and use, compared to metal caps, nonetheless provide unique problems which result from limitations in molding and forming. Whereas metal caps can be formed directly on the bottles into a shape requiring destructive and tamper evident removal, plastic caps are typically molded, into form, separately before being placed on the bottles. As a result, the cap seating procedure can, by diligent tampering, be reversed without evidence of such reversal. Various plastic cap configurations with tamper evident "pilfer-proofs" have been utilized to minimize the ability to reverse the seating procedures without evidence of tampering. Such configurations have however entailed substantial trade-offs either in effectiveness or in utility since the very act of making the caps tamper proof, by making the pilfer proofs more difficult to remove, also makes the cap more difficult to seat.

In U.S. Pat. Nos. 4,592,475 and 4,673,158, an economical and successfully operating pilfer-proof bottle cap and its method of manufacture are described. In these patents a plastic pilfer-proof screw-on bottle cap is disclosed having a substantially co-planar ring section attached thereto with frangible bridges. The ring section has inwardly extending molded-in-place hooks, circumferentially positioned at the edge of the ring section distal to the cap. During torqued seating of the cap on a bottle, the hooks are caused to collapse and fold outwardly into a recess, by being cammed by a radially extending bead of the bottle thereby permitting them to pass the bead. After the free ends of the hook pass the bead, they spring back to engage the lower surface of the bead, thereby preventing upward movement (i.e. removal) of the ring together with removal of the bottle cap. The frangible bridges break under continued removal forces, i.e., unscrewing of the cap, thereby causing the ring to become detached as an indication of tampering. Deliberate disengagement of the hooks from the bead by insertion of a knife blade (where bottle structure permits) into the spacing between the ring and the bottle, to force the hooks into the collapsed or folded original seating position (wherein the cap and ring can be removed together in a single unit) is minimized by the small spacing afforded between the ring and the bottle for insertion of the blade. It may however be possible for a dextrous tamperer to cause disengagement between the hooks and the bottle bead by first tightening the cap on the bottle to disengage the hooks from contact with the bead. Thereafter, the lower end of the ring, at the point of attachment to the hooks, is carefully squeezed inwardly and slightly upwardly. This causes the hooks to swivel outwardly away from the edge of the bead. The cap can then be slipped off the bottle, with the hooks sliding past the edge of the bead, without formation of the tell-tale separated ring.

It is an object of the present invention to further minimize if not substantially eliminate the deliberate external disengagement of the aforementioned hooks from the bead of the bottle whereby the cap cannot be removed without breakage of the bridges and disengagement of the tampering indicator ring from the cap.

It is a further object of the present invention to arrange the bridges relative to the bead of the bottle whereby tampering manipulation causes the bridges to be broken by the bead.

These and other objects, features and advantages of the present invention will become more evident from the following discussion and drawings in which:

FIG. 5 shows the cap of FIG. 3 when tampered with.

Figure 1:
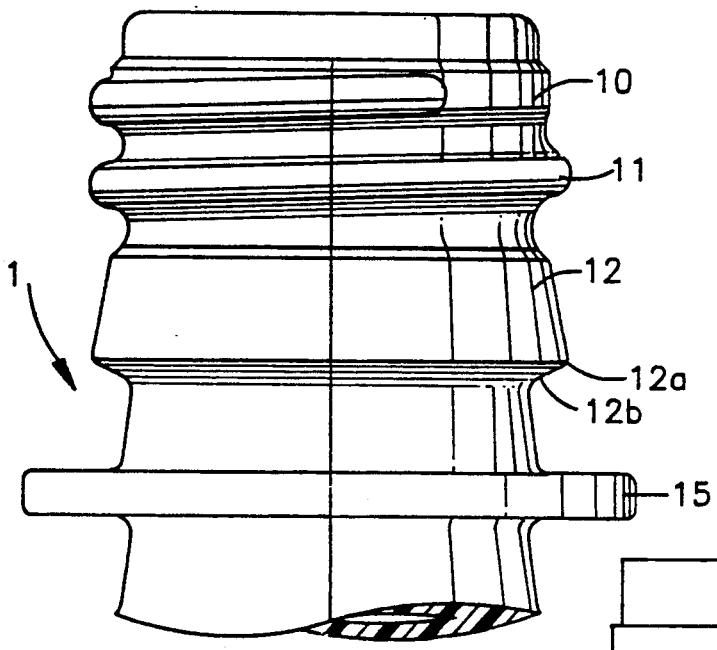
FIG. 1 is an elevation view of a bottle end adapted for a screw-cap closure.

Generally the present invention comprises an improved pilfer-proof screw-on bottle cap of the type, described above, having a ring section attached thereto with frangible bridges. The ring section has inwardly extending spaced apart hooks (at least 4 hooks and preferably about 8), circumferentially positioned at the edge of the ring section distal to the cap and adapted to engage the lower surface of a radially extending bead on the bottle. This engagement prevents upward movement of the ring section with unscrewing removal of the bottle cap. In normal use, the frangible bridges break under continued removal forces, thereby causing the ring section to become detached as an indication of tampering or that the bottle has been previously opened. In accordance with the present invention, in order to ensure that removal of the cap causes a visible breakage of the bridges and separation of the indicator ring, the bridges are proximally laterally aligned no higher than the lower edge of the hook-engaging bead of the bottle, when the cap is seated on the bottle. In order to provide tolerances for high speed cap placement, there is a certain degree of free play for rotational movement of the cap before breakage of the bridges and formation of the tell-tale ring separation. Accordingly, the relative positioning, of the bridges being no higher than the lower edge of the bottle bead, is maintained throughout free turning movement of the cap without bridge breakage. This ranges from tight engagement between the hooks and the underside of the bead, just prior to breakage, to tightening of the cap on the bottle with slight removal of the hooks from the underside of the bead. As a result, the inward squeezing of the cap to move the hooks away from the bead causes the lower edge of the bead to act as a shearing fulcrum with breakage of the bridges in a tell-tale manner. The ring and bridges form a lever which swivels on the bead edge as a fulcrum until the bridges are sheared. When, as in the prior art, the bridges are adjacent to or above the bead, the bead acts as a stop to prevent breakage of the bridges when the hooks are being disengaged by the manipulative squeezing. The bridges should not however, be too far displaced from the lower edge of the bead whereby there is sufficient flexibility for the ring and bridges to bend inwardly to a stop, prior to breakage of the bridges.

For production purposes, particularly with compression molding of the caps, it has previously been the practice to form the bridges laterally above the hooks, i.e. adjacent to the body of the bead or higher rather than below or adjacent the lower edge of the bead. Such practice was probably dictated by the manner in which the caps were formed, i.e., initially without bridges and then scored to form the bridges and the separable ring section. The scoring and concomitant bridge formation was made above the level of the hooks, which engage the lower end of the bead, in order to avoid cutting the hooks themselves. As a result, the bridges invariably were laterally adjacent to the bottle bead or higher and were supported thereby against breakage when inwardly squeezed by tampering.

Formation of the cap with injection molding procedures, i.e. with molded-in bridges, does not entail the problem of cutting of the hooks. However, because of the camming necessary with injection molding, greater care must be taken when lowering the bridges into the more space-constricted area adjacent the hooks. In order to prevent cutting of the hooks, with compression molding procedures, the hooks may be provided with internal stops which hold the hooks away from the ring a sufficient distance to prevent them from being cut during the formation of the bridges but which still permit them to slide past the bead during initial seating.

It is preferred that the bridges be circumferentially offset from the hooks in order to assure that the bridges are severed by the tampering squeezing against the lower edge of the bead. This positioning prevents even the slightest support against such severing which may be afforded by the hooks themselves.

Figure 2:
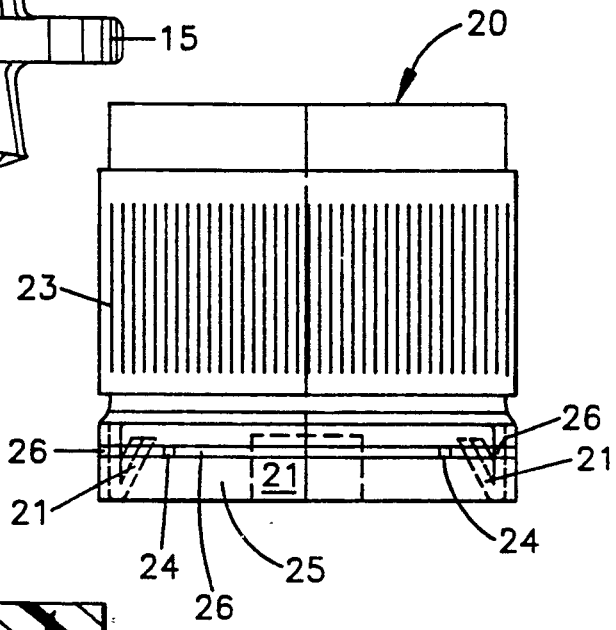
FIG. 2 is an elevation view of the bottle cap of the present invention.

With specific reference to the drawings, FIG. 1 depicts a typical plastic bottle 1 with end 10 having a screw thread 11 for emplacement of a screw-on-cap. At the lower periphery of the thread 11 is a circumferential bead 12 having a lower flared out edge 12*a* and angled bottom peripheral surface 12*b*. Neck bead or bottle ring 15 (present in plastic bottle though not usually in glass bottles) serves to provide finger support for carrying or manipulating the bottle. FIG. 2 depicts a pilfer-proof cap 20, as described in detail in U.S. Pat. Nos. 4,592,475 and 4,673,158 (the disclosures of which are incorporated herein by reference) for use with the bottle of FIG. 1, as a tamper evident closure therefor, and with the modification of the present invention. The cap 20 comprises a knurled (for facilitated gripping) threaded closure or cap section 23, a ring section 25, co-planar with the cap section, and bridges 24 therebetween. The bridges 24 (shown thinned in FIG. 3 for clarity, though they may be the same thickness as the surrounding cap material) are below the level of the upper end of the hooks whereby it is also at or below the lower edge 12*a* of the neck bead 12. The bridges are readily frangible in their connection to the cap section 23 and the ring section 25. As shown in phantom in FIG. 2 and more clearly in FIG. 3, circumferentially placed hooks 21, integrally molded to the lowermost edge of ring section 25, extend inwardly and upwardly toward cap section 23. Separating the ring section 25 from the cap section 23 are slits 26 (shown in exaggerated dimension for clarity) and unbroken portions or the bridges 24. During removal of the cap 20 by unscrewing, forces causing the hooks 21 to engage the bottle bead are directly transmitted to the weak portion separating the ring and the cap (i.e. the slits 26) to cause breakage of the bridges. This permits opening of the bottle and the separation of the ring section 25 from the cap section 23 as an indication that the bottle 1 has been opened.

Figure 3:
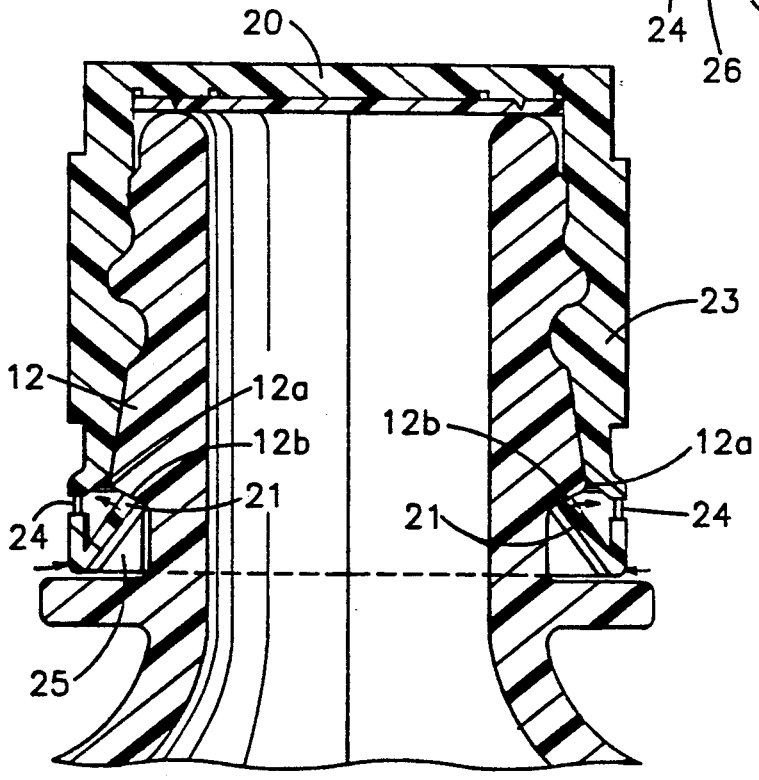
FIG. 3 is a cross section view of the bottle cap of FIG. 2 seated on the bottle end of FIG. 1.

When the cap 20 is fully seated on the bottle end, as shown in FIG. 3, the hooks 21 engage the lower peripheral surface 12*b* of retaining bead 12. The hooks, with such engagement, resist upward movement of the ring section 25 when the cap 20 is being unscrewed. During removal of the cap 20, the bridge portion 24 circumferentially stretches and breaks thereby leaving the telltale separated indicator ring 25 on the bottle 1.

Figure 5:
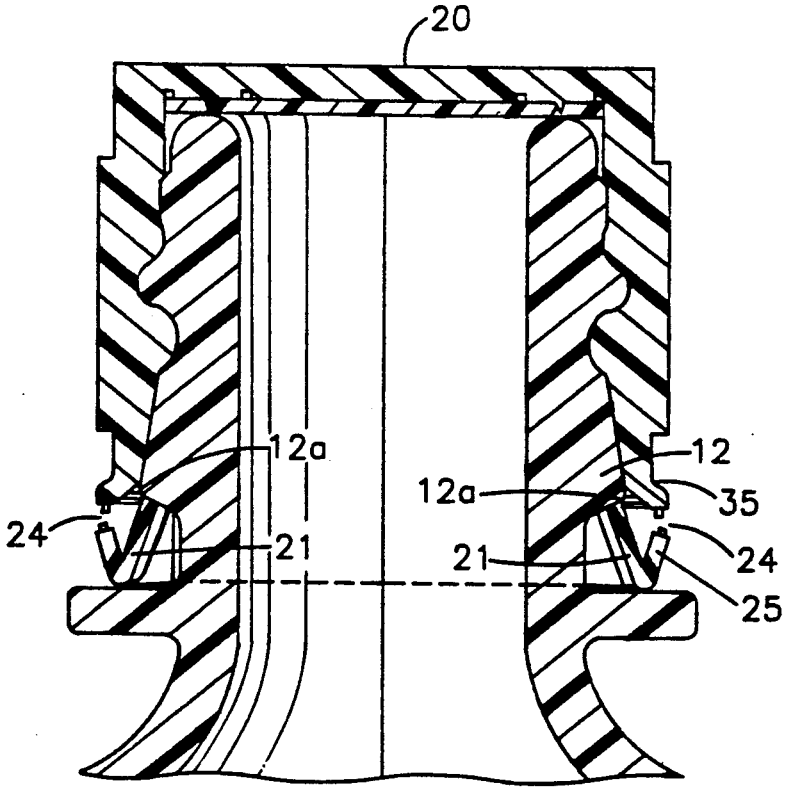

A tampering method involves applying pressure to the lower end of the hooks 21 in the direction indicated by the arrows. This in turn causes the hooks 21 to pivot outwardly away from the bottle bead 12 whereby the hooks can pass the outer periphery of the bead without causing separation of the ring 25. However, as can be seen in FIGS. 3 and 5, the bridges 24 are just below the lower edge 12*a* of the bead 12 whereby such tampering pivoting causes the bridges to stretch to breakage, with the edge 12*a* functioning as a pivot or fulcrum for the bridges and ring which, in effect, become frangible levers for such breakage. In the prior art, the position of the bridges was at 35 wherein the squeezing type of tampering caused the bridges to be supportingly pushed against the outer surface of bead 12 with bridge breakage being prevented by such support. To ensure breakage, the bridges 24 are circumferentially offset from the hooks 21, i.e. not directly lateral to the hooks (as shown in FIG. 2), whereby the levers of the ring 25 and bridges 24 have more room to swivel (without any support being provided by hooks 21) against the fulcrum shearing force of the lower edge of the bead 12*a*.

Figure 4:
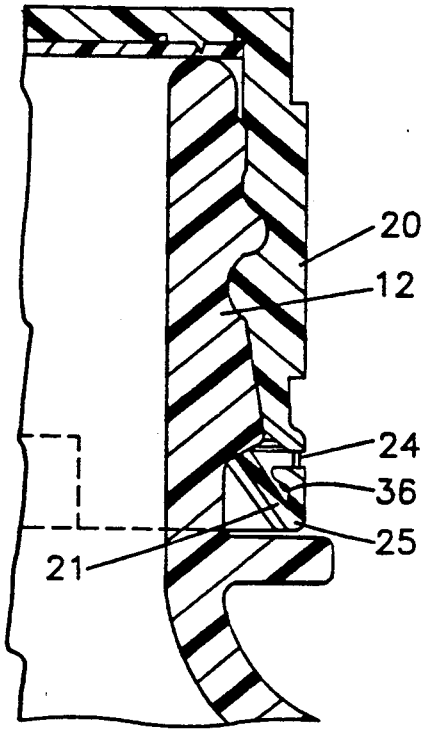
FIG. 4 is an embodiment having means for preventing scoring of the hooks during formation of the bridges.

As shown in FIG. 4, in order to prevent cutting of the hooks 21 during formation of the bridges 24, a small stop 36 in the form of a slight protrusion on the interior of each of the hooks 21 prevents the hooks from becoming flush with the interior surface of the cap 20. The stops 36 hold the hooks away from the tooling which cuts the cap 20 in the formation of the ring 25 and bridges 24.

It is understood that the above specific embodiments of the present invention are illustrative in nature and details described therefor are not to be construed as limitations on the present invention. Changes in structure and configuration, such as the number of hooks, whether the hooks are molded in place or pushed into position, the relative positioning and dimensions of the various elements of the bottle and the cap and the like may be made without departing from the scope of the present invention as defined in the following claims.

What is claimed is:

1. A plastic pilfer-proof cap for a bottle having an open end, a screw thread adjacent its open end and a circumferential retaining bead below the screw thread, away from the open end of the bottle, said retaining bead having a lower peripheral edge distal to the screw thread and a lower peripheral surface adjacent the lower peripheral edge; the cap comprising a cap section having an open end adapted to be threaded on said screw thread, and a ring section attached to the open end of the cap section by one or more frangible bridges therebetween; the ring section having a free edge distal from the one or more bridges, and a plurality of circumferentially placed hook elements having free ends which extend inwardly and upwardly; the hook elements being integrally molded with the ring section at the edge of the ring section distal from the one or more bridges; the ring section having a portion thereof, adjacent said hook elements, of an inner diameter larger than that of said cap section which thereby provides a recess therein for accommodation of said hook elements; with the hook elements being adapted to adjacently pass over the screw thread and retaining bead of the bottle when the cap is initially threaded on the bottle, and wherein the hook elements are adapted to fold outwardly away from the bottle into said recess, when in adjacent peripheral contact with the retaining bead, whereby the hook elements can pass by the bead; with the hook elements springing back to their original conformation when they pass beyond a lower peripheral edge of the retaining bead, the free ends of the hook elements being adapted to engage a lower peripheral surface of the retaining bead, whereby unscrewing of the cap from the bottle causes the one or more frangible bridges to break, with the ring section remaining on the bottle as an indication of opening of the bottle, characterized in that the one or more bridges are laterally aligned with said bead at a position no higher than the lower peripheral edge of said bead, when the cap is seated on the bottle, and wherein said bead is in contact with a region of said cap section, peripherally adjacent said one or more frangible bridges, whereby when said ring is compressed at said edge, distal to the one or more bridges, to cause the hook elements to swivel, from engagement with said bead, into said recess, with the ring section and cap being thereby removable from the bottle; the lower peripheral edge of the bead functions as a fulcrum for swiveling breakage of the one or more bridges, upon continued compression of said edge, distal to the one or more bridges, of said ring section, with said swiveling breakage occurring prior to disengagement between the hook elements and the bead and movement of the hook elements into said recess.

2. The pilfer-proof cap of claim 1 wherein the cap section and ring section are substantially co-planar.

3. The pilfer-proof cap of claim 1 whereinn the one or more bridges are circumferentially removed from a position adjacent said hook elements.

4. The pilfer-proof cap of claim 1 wherein the ring section comprises at least four hook elements.

5. The pilfer-proof cap of claim 1 wherein the ring section comprises at least eight hook elements.

6. The pilfer-proof cap of claim 1 wherein the cap with ring section and and bridges is formed by injection molding.

7. The pilfer-proof cap of claim 1 wherein the cap is formed by compression molding, with the cap being partially circumferentially scored at a position laterally adjacent said hook elements to form the ring section, with unscored portions, circumferentially adjacent the position being circumferentially scored, forming the one or more bridges.

* * * * *